United States Patent [19]

Acampora

[11] 4,211,989

[45] Jul. 8, 1980

[54] CIRCUIT BREAKER BELL ALARM AND LOCKOUT ACCESSORY APPARATUS

[75] Inventor: Vincent P. Acampora, Bristol, Conn.

[73] Assignee: General Electric Company, New York, N.Y.

[21] Appl. No.: 948,079

[22] Filed: Oct. 2, 1978

[51] Int. Cl.[2] ..... H01H 73/12; H01H 75/00; H01H 77/00

[52] U.S. Cl. ..... 335/17; 200/308; 335/170

[58] Field of Search ..... 335/13, 17, 18, 20, 335/34, 168, 169, 170; 200/308

[56] References Cited

U.S. PATENT DOCUMENTS

| | | | |
|---|---|---|---|
| 2,460,758 | 2/1949 | Lawson | 335/17 |
| 3,070,682 | 12/1962 | Yarrick et al. | 200/167 |
| 3,806,686 | 4/1974 | Gaskill | 200/308 |
| 3,955,162 | 5/1976 | Nicol | 335/17 |
| 4,001,739 | 1/1977 | Powell et al. | 335/34 |

*Primary Examiner*—Fred L. Braun

*Attorney, Agent, or Firm*—Robert A. Cahill; Walter C. Bernkopf; Philip L. Schlamp

[57] ABSTRACT

An actuating arm, coupled with the breaker contacts, is pivotally mounted to an accessory latch normally constrained from pivotal movement by a latch lever. Upon automatic tripping of the breaker, the actuating arm is swung about its pivotal mounting to a breaker lockout position, incidentally releasing an operating lever for movement from a de-actuating position to a bell alarm switch actuating position. Unlatching of the latch by the latch lever allows the actuating arm to swing about the latch pivot to a defeat position, removing the breaker lockout and returning the switch operating lever to its de-actuating position. The accessory latch is relatched, via the actuating arm, coincidentally with closure of the breaker contacts.

10 Claims, 8 Drawing Figures

CIRCUIT BREAKER BELL ALARM AND LOCKOUT ACCESSORY APPARATUS

BACKGROUND OF THE INVENTION

The present invention relates to accessory equipment for industrial circuit breakers, and particularly to a combined circuit breaker bell alarm and lockout accessory apparatus.

Automatic electric circuit breakers, particularly those of the industrial type, are often equipped with so-called bell alarm switches operating to complete a signal circuit and thus sound an alarm at a remote location to indicate that the circuit breaker has been automatically tripped to interrupt its circuit. Typically, the alarm is for the benefit of maintenance personnel to alert them to the existence of an abnormal circuit condition requiring prompt corrective measures. The bell alarm switch is normally adapted to be actuated only when the circuit breaker is tripped automatically because of an overcurrent condition or an undervoltage condition, and not when the circuit breaker is opened via its manual operating handle or when the breaker is manually tripped.

When the circuit breaker has been tripped automatically, it is important that it not be reclosed until the abnormal circuit condition precipitating the trip function has been corrected. Unauthorized reclosure of the circuit breaker before or during correction of the abnormal condition can produce harmful consequences to equipment and maintenance personnel.

It is accordingly an object of the present invention to provide improved apparatus for automatic industrial circuit breakers in which bell alarm and breaker lockout accessorial functions are structurally integrated.

A further object is to provide a circuit breaker accessory apparatus of the above character which is structured to impose a combined breaker lockout and bell alarm function incident with automatic tripping of the circuit breaker.

An additional object is to provide circuit breaker accessory apparatus of the above character which is structured for convenient cancelling of the bell alarm and breaker lockout function once it has been imposed incident to automatic tripping of the breaker and for automatically inhibiting the bell alarm and lockout function when tripping of the breaker is manually initiated.

Yet another object is to provide circuit breaker accessory apparatus of the above character which is inexpensive to manufacture, reliable in operation and convenient to use.

Other objects of the invention will in part be obvious and in part appear hereinafter.

SUMMARY OF THE INVENTION

In accordance with the present invention, there is provided accessory apparatus for industrial circuit breakers operating automatically in response to overcurrent, undervoltage and/or ground fault tripping of the circuit breaker to impose a lockout function preventing the breaker mechanism from being reset and to actuate a bell alarm switch suitable for activating an alarm signalling that the circuit breaker has tripped in response to an abnormal circuit condition. To this end, the accessory apparatus includes an actuating arm operatively coupled adjacent one end to the breaker mechanism and pivotally mounted to a latch member. The latch member, in turn, is pivotally mounted to a frame. A latch lever, movably mounted by the frame, is normally spring biased into latching engagement with the latch member to constrain the latter from pivotal movement about its mounting with the frame.

While the breaker contacts are closed, the actuating arm assumes a reset position effective in holding an operating arm for a bell alarm switch in a de-actuating position against the bias of an activating spring. When the breaker contacts are tripped open automatically in response to an overcurrent, undervoltage and/or ground fault condition, the actuating arm is swung about its pivotal mounting with the latch member to a lockout position. Thusly positioned, the actuating arm engages breaker mechanism latch means to disenable attempts to reset the mechanism and further releases the operating arm for movement under the urgence of its activating spring to a bell alarm switch actuating position.

To jointly defeat this disablement of the breaker mechanism latch and the continued sounding of a trip alarm initiated by the bell alarm switch actuation, the latch lever is articulated, either manually or electromechanically, to unlatch the latch member. The latch member is thus free to pivot about its mounting with the frame under the urgence of a spring, which, in the process, swings the actuating arm to a defeat position in disengaged relation with the breaker mechanism latch means. Moreover, movement of the actuating arm to its defeat position picks up the bell alarm switch operating lever, repositioning it to its de-actuating position and thereby terminating the sounding of the trip alarm. The breaker contacts can now be reclosed, and, in doing so, the actuating arm is moved to its reset position. In the process, the actuating arm maintains the switch operating lever in its de-actuating position and, in addition, picks up the latch member, returning it to a position where it can be latchably re-engaged by the latch lever. The accessory apparatus is thus fully reset and prepared to reimpose its breaker lockout and bell alarm accessorial functions when the circuit breaker is next tripped in response to an abnormal circuit condition.

To inhibit the bell alarm and lockout function when the breaker is manually tripped open, the latch lever is coupled with the manual tripping means such that it unlatches the latch member incident with actuation of the manual tripping means. Thus, the actuating arm swings about the latch member pivotal mounting from its reset position directly to its defeat position, rather than to its lockout position. Consequently, the actuating arm does not disenable the breaker mechanism latch means and maintains the operating lever in its switch de-actuating position.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings, in which.

Corresponding reference numerals refer to like parts throughout the several views of the drawings.

DETAILED DESCRIPTION

Figure 1:
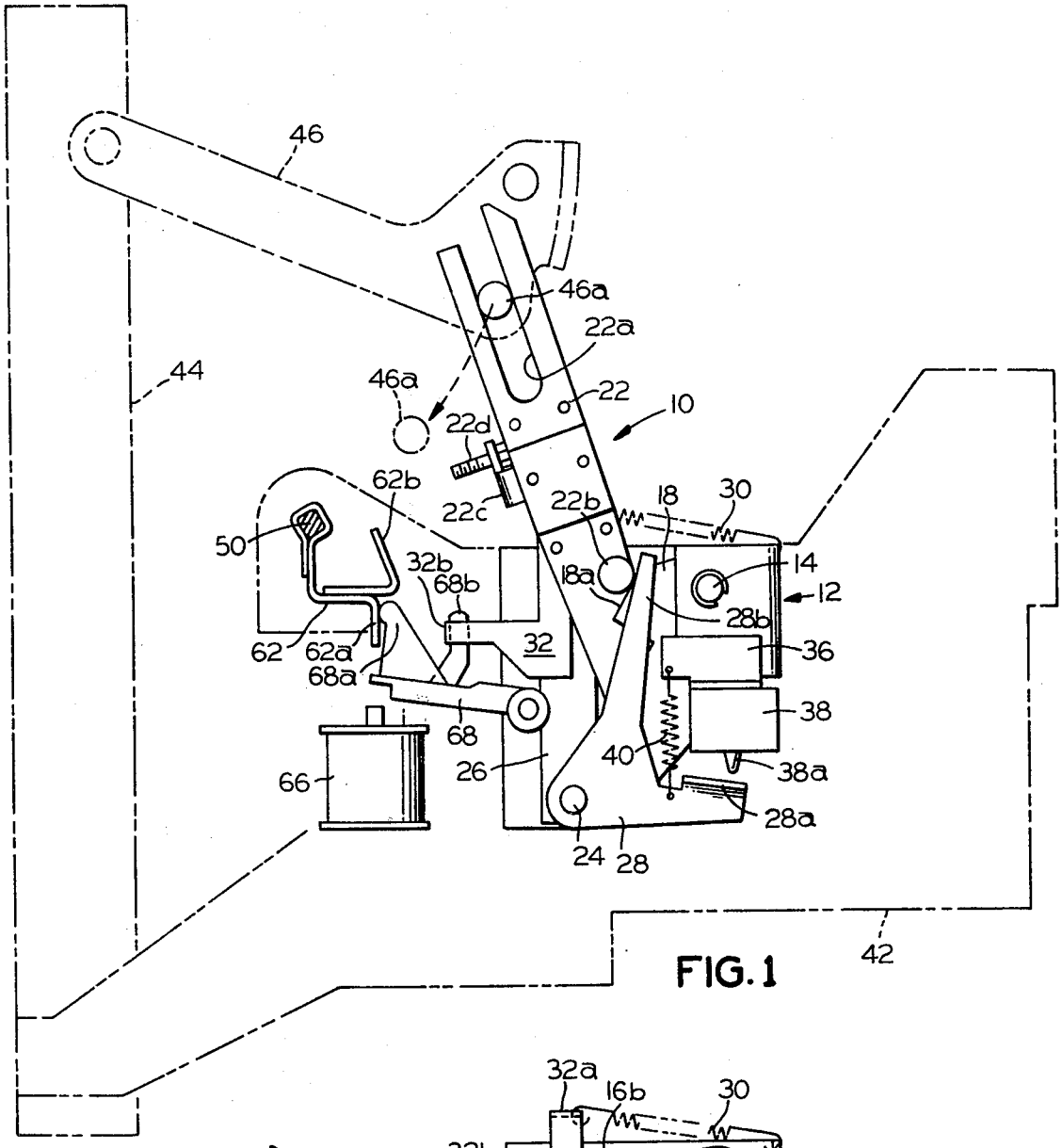
FIG. 1 is a side elevational view of the circuit breaker bell alarm and lockout accessory apparatus of the invention, shown in its reset condition.
Figure 2:
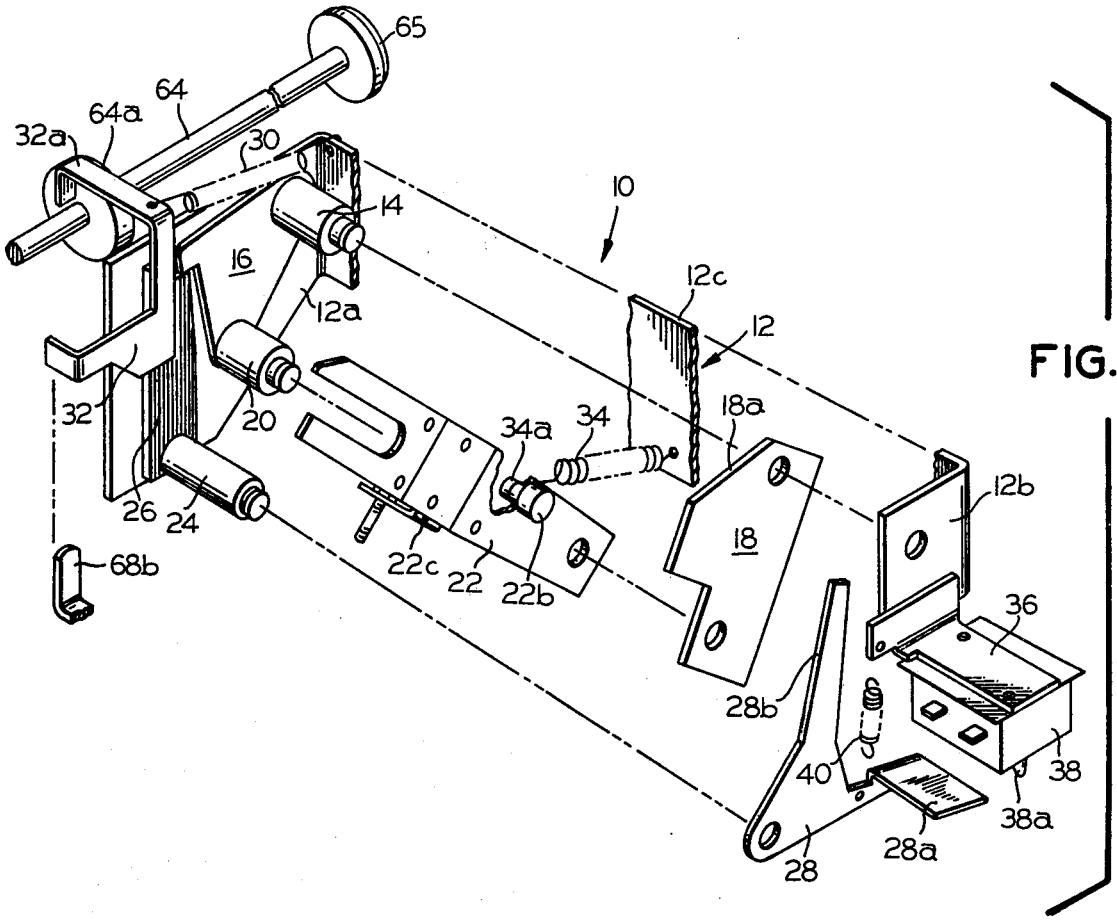
FIG. 2 is an exploded, perspective view of the accessory apparatus of FIG. 1.

The circuit breaker bell alarm and lockout accessory apparatus of the present invention, generally indicated at 10 in FIGS. 1 and 2, includes a generally U-shaped frame 12 consisting of opposed sideplates 12*a*, 12*b* and an interconnecting bight portion 12*c*. As best seen in FIG. 2, a pin 14, mounted by the frame sideplates, in turn pivotally mounts a triangular-shaped latch member 16 adjacent one of its corners and a reset link 18 adjacent its upper end. A pine 20, secured at its ends to the lower corner of latch member 16 and the lower end of reset link 18, serves to pivotally mount an elongated actuating arm 22 adjacent its lower end. Cantilever mounted to frame sideplate 12*a* is a pin 24, which serves to pivotally mount a latch lever 26 and a switch operating lever 28.

Figure 3:
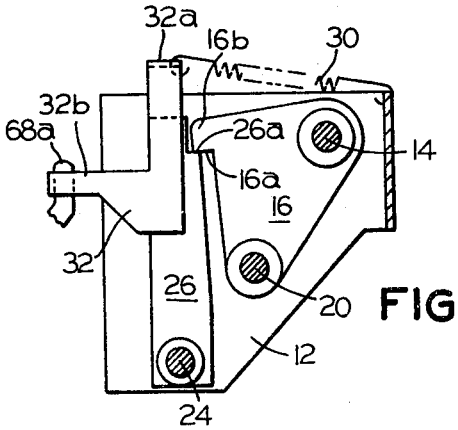
FIG. 3 is a fragmentary, side elevational view of the accessory apparatus of FIG. 1, depicting certain parts thereof in their reset positions.

As best seen in FIG. 3, the upper end of latch lever 26 is relieved to provide a latch shoulder 26*a* for latchably engaging a latch surface 16*a* formed in the underside of a nose 16*b* provided at the third corner of latch member 16. A tension spring 30, hooked at one end to the frame bight portion 12*c* and at its other end to a bracket 32 affixed to the upper end portion of latch lever 26, acts to bias the latch lever in the clockwise direction about its pivot pin 24 into latching engagement with latch member 16. It is seen that while this latching engagement is maintained, pivotal movement of the latch member about its pivot pin 14 is restrained against the bias of a tension spring 34 hooked at one end to frame bight portion 12*c* and at its other end to a pin 34*a* carried by actuating arm 22. A bracket 36 serves to mount a bell alarm switch 38 to frame sideplace 12*b* in position to be actuated by a paddle 28*a* carried by operating lever 28. Tension spring 40, connected between bracket 36 and operating lever 28, biases this lever in the counterclockwise direction about its pivot pin 24 to urge paddle 28*a* into actuating engagement with the bell alarm switch actuator 38*a*.

Turning to FIG. 1, the accessory frame is mounted to a sideplate 42 of the breaker mechanism frame which further includes a secondary frame member 44 serving, among other things, to pivotally mount a link 46 included as part of linkage controlling the articulation of the breaker movable contacts (not shown) between their closed and open circuit positions. The upper end of actuating arm 22 is forked to provide an elongated slot 22*a* in which is received a pin 46*a* carried by link 46. With the breaker contacts closed, pin 46*a* assumes its solid line position seen in FIG. 1, forcing actuating arm 22 to assume a reset angular position. When the breaker movable contacts assume their open circuit condition, link 46 pivots in the clockwise direction, swinging pin 46*a* to its phantom line position seen in FIG. 1. As a consequence, actuating arm 22 is pivoted in the counterclockwise direction about pin 20 to a lockout position seen in FIG. 4.

Figure 7:
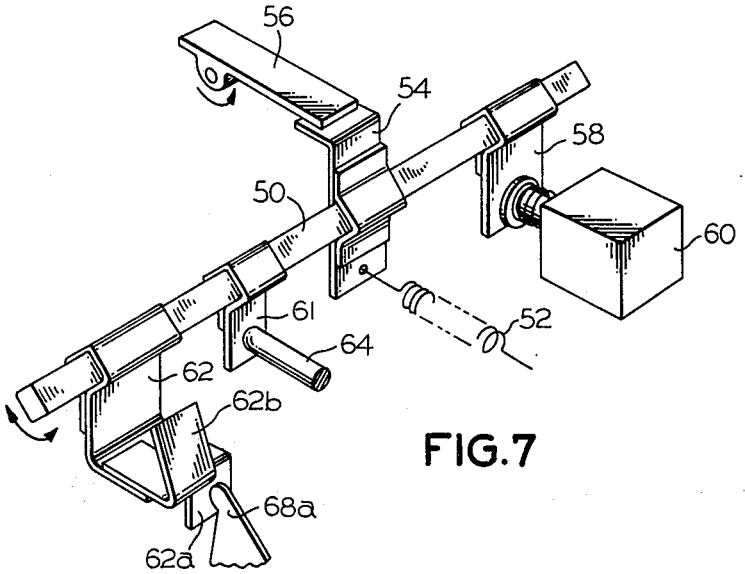
FIG. 7 is a simplified perspective view of a portion of a breaker mechanism latch means, exemlifying the operational relationship of the accessory apparatus of FIG. 1 thereto.

Rotatably mounted between the breaker mechanism side mounting plates 42 is an elongated trip bar 50. For purposes of simplicity, the trip bar is shown in FIG. 7 as being biased by a tension spring 52 in the counterclockwise direction against a stop (not shown) so as to normally position a flange 54, secured on the trip bar, in trip initiating relation with a primary latch 56 sustaining the breaker operating mechanism in its reset condition. To trip the breaker open, the trip bar 50 is simply rotated in the clockwise direction, causing flange 54 to engage and pivot primary latch 56 in the counterclockwise direction, thereupon precipitating unlatching of the breaker mechanism. To induce such clockwise, circuit breaker tripping rotation of the trip bar, it carries one or more laterally extending flanges 58 positioned to be impacted by an electromechanical trip initiating device, such as a flux shifter 60 energized from a static trip unit in response to the sensation thereby of an abnormal circuit condition. It will be appreciated that the trip bar may carry an additional flange which is acted upon by an undervoltage release solenoid operating to automatically trip the breaker in response to an undervoltage condition on the circuit being protected.

Figure 6:
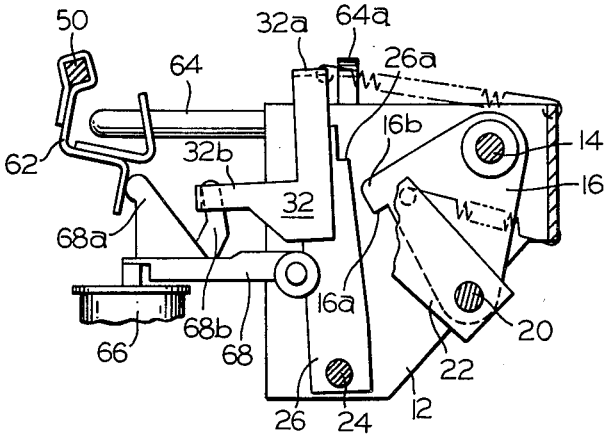
FIG. 6 is a fragmentary side elevational view of the accessory apparatus of FIG. 1, illustrating the manner in which the defeat condition of FIG. 5 is precipitated.

To accommodate manually initiated (non-automatic) tripping of the breaker to open its contacts, trip bar 50 carries an aditional flange 61 positioned to be engaged by the free end of an elongated rod 64 (FIG. 6) whose other end is engaged by a pushbutton 65 (FIG. 2). It is seen that upon depression of the pushbutton 65, rod 64 pushes against flange 61, causing clockwise rotation of trip bar 50 and consequent tripping of the breaker. Alternatively, the circuit breaker is tripped through the energization of a shunt trip solenoid 66 to magnetically attract armature 68 pivotally mounted to the accessory frame sideplate 12*a*. The armature carries a finger 68*a* which impacts against a tab 62*a* carried by a flange 62, similarly secured on the trip bar, thus inducing clockwise rotation of the trip bar to trip the circuit breaker (FIGS. 1, 6 and 7).

It will be noted from FIG. 1 that, while the breaker contacts are closed and the actuating arm 22 is in its reset position, a post 22*b* carried thereby is positioned to engage an upstanding finger 28*b* of operating lever 28, forcing this lever to assume its de-actuating position against the bias of spring 40. Paddle 28*a* is thus held in disengaged relation with respect to the bell alarm switch actuator 38*a*. Thusly de-actuated, the normally open bell alarm switch inhibits the initiation of a suitable trip alarm (not shown), such as a light or bell.

As previously noted, as long as latch lever 26 is latchably engaging latch member 16, the latch member is constrained from pivotal movement about its mounting pin 14 under the influence of spring 34. Consequently, when the breaker contacts open, actuating arm 22 swings to its lockout position seen in FIG. 4 solely via its pivotal mounting with latch member 16, i.e., pin 20. It is seen that with the actuating arm in its lockout position, post 22*b* swings away from finger 28*b* of operating lever 28, thereby permitting spring 40 to propel paddle 28*a* into switch actuating engagement with actuator 38*a* of bell alarm switch 38. The bell alarm switch closes to thereby initiate the trip alarm.

Figure 4:
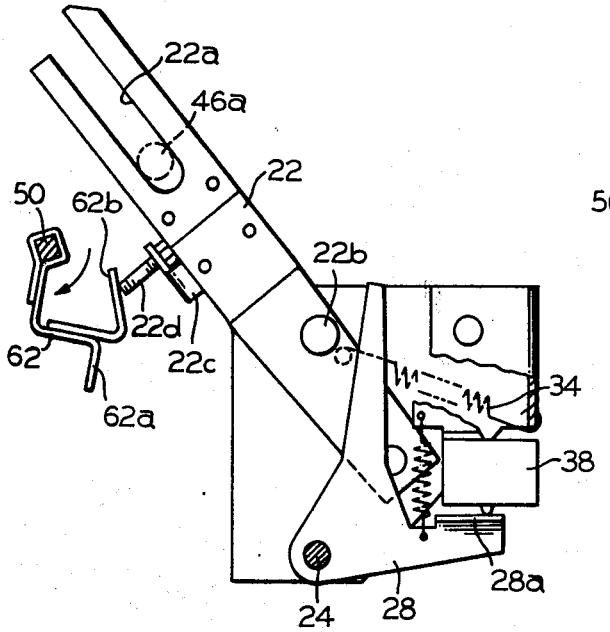
FIG. 4 is a side elevational view, partially broken away, of a portion of accessory apparatus of FIG. 1, shown in its condition imposing the combined bell alarm and lockout function.

As also seen in FIG. 4, actuating arm 22 carries a bracket 22*c* through which is adjustably threaded a screw 22*d* to position its tip to engage an upwardly turned tab 62*b* carried by flange 62 when the actuating arm assumes its lockout position. This engagement holds trip bar 50 in is clockwise-most position, which, in turn, via flange 54 (FIG. 7) holds primary latch 56 in a latch disenabled disposition. Under these circumstances, the breaker is locked out inasmuch as resetting of the breaker operating mechanism, a prerequisite to closing the breaker contacts, is precluded. Consequently, with the actuating arm in its lockout position, the breaker contacts cannot be closed and the trip alarm remains activated through the now closed bell alarm switch 38.

Figure 5:
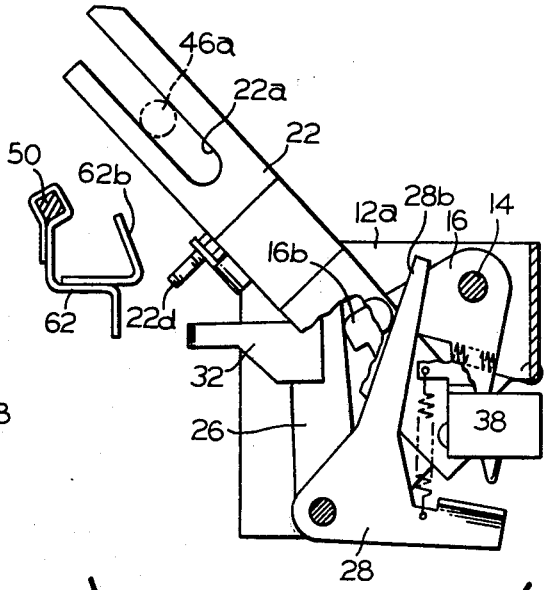
FIG. 5 is a side elevational view, partially broken away, of a portion of accessory apparatus of FIG. 1, shown in its bell alarm and lockout function defeat condition.

To remove the braker lockout restraint and to discontinue activation of the trip alarm, latch lever 26 is articulated in the counterclockwise direction, seen in FIGS. 3 and 6, to disengage its latch shoulder 26*a* from the latch surface 16*a* of latch member 16. The latch member is thus freed for counterclockwise rotation about its pivot pin 14 under the urgence of spring 34. Actuating arm 22 is thus swung about pivot pin 14 from its lockout position of FIG. 4 to a defeat position seen in FIG. 5. Thusly positioned, lockout screw 22*d* is disengaged from tab 62*b*, permitting trip bar 50 to be rotated back to its counterclockwise-most position under the urgence of spring 52 (FIG. 7). Breaker latch 56 can thus return to its latch enabling position, whereupon the breaker mechanism can be reset and the breaker contacts reclosed. Furthermore, as the actuating arm assumes its defeat position from its lockout position, post 22*b* picks up finger 28*b* of operating lever 28, pivoting this lever to its switch de-actuating position. Its paddle 28*a* is thus removed from actuating engagement with bell alarm switch actuator 38*a*, and the bell alarm switch opens to terminate the trip alarm.

In accordance with a feature of the present invention, latch lever 26 is articulated to unlatch latch member 16 either via depression of pushbutton 65 or via energization of shunt trip solenoid 66. From FIG. 2 it is seen that the pushbutton trip rod 64 carries a flange 64*a* which is positioned to engage a laterally extending arm 32*a* of bracket 32 affixed to trip lever 26. Consequently, upon depression of the pushbutton, flange 64*a* picks up bracket arm 32*a*, causing latch lever 26 to be pivoted out of latching engagement with latch member 16. Alternatively, upon manually initiated energization of the shunt trip solenoid 66, an upright finger 68*b* carried by armature 68 picks up a second bracket arm 32*b*, causing latch lever 26 to be likewise pivoted out of latching engagement with latch member 16.

Upon resetting of the breaker mechanism, the subsequent closure of the breaker contacts returns actuating arm 22 to its reset position of FIG. 1. In the process, actuating arm post 22*b* engages an angular edge 18*a* of reset link 18, forcing the actuating arm, reset link and latch member 16 to pivot as a unit about pin 14. The latch member is thus pivoted in the clockwise direction, elevating its latch nose 16*b* to a position where latch shoulder 26*a* of latch lever 26 can swing under the bias of spring 30 into latching engagement with latch surface 16*a*. Additionally, as actuating arm 22 swings from its defeat position to its reset position, its post 22*b* rides upwardly along the edge of operating lever finger 28*b*, thereby maintaining the operating lever in its bell alarm switch de-actuating position.

As previously noted, it is desirable that the bell alarm and lockout function not be imposed when the breaker is tripped for reasons other than an abnormal circuit condition. More specifically, it is preferable that the bell alarm and lockout function not be imposed when the breaker is tripped open upon depression of pushbutton 65 or upon energization of shunt trip solenoid 66. It is seen that the accessory apparatus of the present invention is uniquely structured to meet these requirement. As described above, depression of pushbutton 65 or energization of shunt trip solenoid 66 is effective in removing the breaker lockout restraint and terminating the trip alarm following automatic tripping of the breaker due to abnormal circuit condition. This is achieved through the unlatching of latch member 16. It is seen that with the breaker contacts closed and theactuating arm 22 thus in its reset position, depression of pushbutton 65 or energization of shunt trip solenoid 66 to trip the circuit breaker open incidentallyarticulates latch lever 26 to unlatch trip member 16. Consequently, the motion of actuating arm 22 in joint response to the opening movement of the breaker contacts and the urgence of spring 34 is a swinging motion about the latch member pivot pin 14 rather than a pivotal movement about its pivot pin 20. Under these circumstances, the actuating arm assumes its defeat position rather than its lockout position in response to manually initiated tripping of the circuit breaker. The lockout screw 22*d* does not engage tab 62*b* and thus no breaker lockout function is imposed. Furthermore, while actuating arm 22 is moving directly to its defeat position from its reset position, post 22 continues to hold operating lever 28 in its bell alarm switch de-actuating position.

Figure 8:
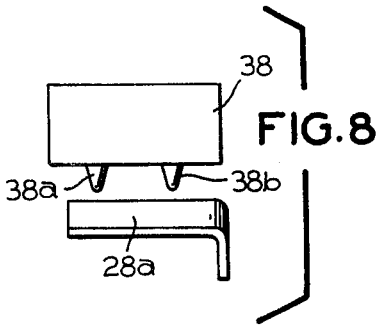
FIG. 8 is a fragmentary view depicting the optimal inclusion of a second auxiliary switch, in addition to a bell alarm switch, in the accessory apparatus of FIG. 1.

In certain applications, the lockout function may not be desired, in which case screw 22*d* is backed off or removed. It is noted that the removal of this lockout screw has no affect on the bell alarm function. As seen in FIG. 8, the bell alarm switch may be combined with a second, auxiliary switch, either of the normally open or normally closed type depending on the control function desired, whose actuator 38*b* is jointly actuated with bell alarm switch actuator 38*a* by paddle 28*a*.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described my invention, what I claim as new and desire to secure by Letters Patent is:

1. Circuit breaker accessory apparatus comprising, in combination:

A. a frame;

B. an accessory latch pivotally mounted to said frame;

C. a spring biasing said accessory latch for pivotal movement in a first direction;

D. a latch lever mounted to said frame and biased into latching engagement with said accessory latch to constrain pivotal movement thereof in said first direction;

E. an actuating arm operatively coupled adjacent one end with the breaker movable contacts and mounted at its other end to said accessory latch for pivotal movement from a reset position to a lockout position upon automatic tripping of the circuit breaker to open its contacts;

F. an auxiliary switch;

G. an operating lever mounted by said frame for movement between a de-actuating position and an actuating position in actuating engagement with said switch, said operating lever (1) normally biased to its actuating position, (2) held in its de-actuating position by said actuating arm while in its reset position, and (3) released for movement to its actuating position by the movement of said actuating arm to its lockout position; and H. cancelling means acting on said latch lever to release said accessory latch for pivotal movement in said first direction under the urgence of said spring, whereby said actuating arm is swung to a defeat position, thereby engageable returning said operating lever to its de-actuating position.

2. The circuit breaker accessory apparatus defined in claim 1, wherein said actuating arm is returned to its reset position in response to reclosure of the breaker contacts, said apparatus further including relatching means coupling the movement of said actuating arm back to its reset position to said accessory latch for pivoting the latter back into latching engagement with said latch lever.

3. The circuit breaker accessory apparatus defined in claim 2, wherein said cancelling means is operatively coupled with non-automatic circuit breaker tripping means such that said latch lever releases said accessory latch incident with non-automatic tripping of the circuit breaker, whereby said actuating arm is swung about the accessory latch pivotal mounting with said frame from its reset position directly to its defeat position while engageably maintaining said operating lever in its de-actuating position.

4. The circuit breaker accessory apparatus defined in claim 3, which further includes lockout means mounted by said actuating arm, said lockout means engageably disabling circuit breaker mechanism latch means to inhibit reclosure of the breaker contacts only while said actuating arm is in its lockout position.

5. The circuit breaker accessory apparatus defined in claim 4, wherein said cancelling means is operatively coupled with a pushbutton manually depressible to trip the circuit breaker, whereby depression of the pushbutton while the breaker contacts are open precipitates movement of said actuating arm from its lockout position to its defeat position and depression of the pushbutton while the breaker contacts are closed precipitates movement of said actuating arm from its reset position to its defeat position.

6. The circuit breaker accessory apparatus defined in claim 4, wherein said cancelling means is operatively coupled with a shunt trip solenoid electrically energizable to trip the circuit breaker, whereby energization of the solenoid while the breaker contacts are open precipitates movement of said actuating arm from its lockout position to its defeat position and energization of the solenoid while the breaker contacts are closed precipitates movement of said actuating arm from its reset position to its defeat position.

7. The circuit breaker accessory apparatus defined in claim 6, wherein said cancelling means is also operatively coupled with a pushbutton manually depressible to trip the circuit breaker, whereby depression of the pushbutton while the breaker contacts are open precipitates movement of said actuating arm from its lockout position to its defeat position and depression of the pushbutton while the breaker contacts are closed precipitates movement of said actuating arm from its reset position to its defeat position.

8. The circuit breaker accessory apparatus defined in claim 4, wherein said relatching means is in the form of a link, said apparatus further including a first pin supported by said frame and pivotally mounting said accessory latch and said link, a second pin jointly supported by said accessory latch and said link and pivotally mounting said actuating arm, and a post mounted by said actuating arm for engaging said link incident with movement of said actuating arm from its defeat position to its reset position, whereby said actuating arm, accessory latch and link pivot as a unit about said first pin pursuant to returning said accessory latch into latching engagement with said latch lever incident with movement of said actuating arm from its defeat position to its reset position.

9. The circuit breaker accessory apparatus defined in claim 8, wherein said operating lever includes an elongated finger controllably engaged by said post to maintain said operating lever in its de-actuating position while said actuating arm is in its reset and defeat positions and during movement therebetween.

10. The circuit breaker accessory apparatus defined in claim 4, wherein said lockout means is in the form of a screw removably mounted by said actuating arm.

* * * * *